US008206556B2

(12) United States Patent
Claudon

(10) Patent No.: US 8,206,556 B2
(45) Date of Patent: Jun. 26, 2012

(54) CREPING BLADE

(75) Inventor: Alexandre Claudon, Yverdon-les-Bains (CH)

(73) Assignee: BTG Eclepens S.A., Eclepens (CH)

( * ) Notice: Subject to any disclaimer, the term of this patent is extended or adjusted under 35 U.S.C. 154(b) by 561 days.

(21) Appl. No.: 12/309,199

(22) PCT Filed: Jul. 12, 2007

(86) PCT No.: PCT/EP2007/006204

§ 371 (c)(1),
(2), (4) Date: Feb. 19, 2009

(87) PCT Pub. No.: WO2008/006591

PCT Pub. Date: Jan. 17, 2008

(65) Prior Publication Data

US 2009/0188643 A1 Jul. 30, 2009

(30) Foreign Application Priority Data

Jul. 13, 2006 (EP) ..... 06117161

(51) Int. Cl.
*D21G 3/00* (2006.01)

(52) U.S. Cl. ..... 162/281; 162/280; 15/256.51; 118/413

(58) Field of Classification Search ..... 162/280–281; 15/256.51; 418/413
See application file for complete search history.

(56) References Cited

U.S. PATENT DOCUMENTS 3,507,745 A 4/1970 Fuerst
3,688,336 A * 9/1972 Costello et al. ..... 15/256.51
3,703,019 A 11/1972 Bratt
3,869,344 A 3/1975 Hunt et al.
5,674,361 A 10/1997 Marinack et al.
5,690,788 A * 11/1997 Marinack et al. ..... 162/113
5,885,417 A * 3/1999 Marinack et al. ..... 162/111
6,096,168 A * 8/2000 Marinack et al. ..... 162/111
6,207,021 B1 * 3/2001 Eriksson et al. ..... 162/281
6,425,983 B1 7/2002 Marinack et al.
6,540,879 B2 * 4/2003 Marinack et al. ..... 162/281
6,681,692 B2 * 1/2004 Beran et al. ..... 101/157
6,687,950 B1 * 2/2004 Rata et al. ..... 15/256.51

(Continued)

FOREIGN PATENT DOCUMENTS

EP 1878565 A1 * 1/2008

(Continued)

OTHER PUBLICATIONS

English Translation of Chinese Office Action received in Sweden on May 17, 2010 in corresponding Chinese Patent Application No. 200780025985.1.

*Primary Examiner* — Jose A Fortuna
(74) *Attorney, Agent, or Firm* — Buchanan Ingersoll & Rooney

(57) ABSTRACT

A blade for creping a paper web from a dryer surface is provided, said blade having a sliding surface facing the dryer surface during use of the blade, a web impact surface upon which the paper web impacts during creping, and a working apex formed between the sliding surface and the web impact surface, wherein the working apex is located no more than 30 percent of the total blade thickness away from a neutral fiber of the blade. Preferably, the working apex of the inventive creping blade is located at or close to the neutral fiber of the blade. A method for manufacturing the blade is also disclosed.

9 Claims, 7 Drawing Sheets

U.S. PATENT DOCUMENTS

| | | | | |
|---|---|---|---|---|
| 6,709,548 | B2 * | 3/2004 | Marinack et al. | 162/111 |
| 7,244,340 | B2 * | 7/2007 | Laithier et al. | 162/281 |
| 7,691,236 | B2 * | 4/2010 | Conn et al. | 162/281 |
| 2002/0098376 | A1 * | 7/2002 | Morris | 428/667 |
| 2004/0247928 | A1 * | 12/2004 | Morris | 428/615 |
| 2007/0158045 | A1 * | 7/2007 | Sundqvist et al. | 162/281 |
| 2009/0188643 | A1 * | 7/2009 | Claudon | 162/280 |

FOREIGN PATENT DOCUMENTS

| | | | |
|---|---|---|---|
| GB | 2128551 | A | 5/1984 |
| WO | WO2005/023533 | A | 3/2005 |
| WO | WO2005/059246 | A | 6/2005 |
| WO | WO 2008006591 | A1 * | 1/2008 |

* cited by examiner

Tissue creped using conventional blade

Tissue creped using inventive blade

CREPING BLADE

TECHNICAL FIELD

The present invention relates to a creping blade having improved resistance to edge chipping and improved performance with respect to problems associated with edge chipping. The invention also relates to a method for manufacturing such a blade.

BACKGROUND

Creping blades are commonly used in the paper industry for production of tissue. In order to produce the typical bulk characterizing creped tissue, a creping blade is normally used for detaching a paper web from a rigid, hot dryer cylinder (often known as a Yankee dryer) and at the same time exert a compressive action on the paper web.

In this context, there are a number of properties which are desired for the creping blades. The creping blade should be able to overcome the adhesive forces which stick the paper web to the dryer surface. At the same time, the blade should create the desired crepe structure in order to provide the right bulk, softness and mechanical strength to the tissue. For this purpose, the geometry of the blade tip plays an important role. For example, a square edge blade (i.e. 90 degrees bevel) in any given creping situation will create a different tissue than a blade having a sharp edge of, say, 75 degrees bevel under otherwise similar conditions. The square edge blade would, in this example, provide a higher bulk and a coarser crepe structure than the 75 degrees blade.

In addition, and not less importantly, the blade should be able keep the tissue parameters as constant as possible for the longest possible period of time, in order to produce tissue of substantially constant quality. Wear and other damages to the blade tip are therefore important factors determining the quality of the final tissue product, as well as the service life of the blade.

Creping blades are subjected to wear for a number of reasons. For example, there will be sliding wear against the dryer, and there will be impact wear on the blade due to the paper web hitting the blade during creping. It has been found that the progressive wear of the creping blade is directly related to unwanted evolution of the tissue properties, such as changes in bulk or softness. In practice, optimal properties are obtained only with a newly installed blade.

In order to accommodate for the wear of the creping blade, tissue manufacturers are typically specifying ranges of properties which are deemed to be acceptable. Nevertheless, it would be highly appreciated in the tissue industry if the quality obtained during the initial time after a blade change could be maintained for a prolonged period of time.

One type of damage occurring in creping blades is chipping at the working edge of the blade. By chipping, it is meant that small chips of blade material at the blade edge are torn off during creping. Chipping is typically a limiting factor for blades having a hard-covered edge, such as an edge covered with a ceramic, a carbide, a cermet or some other hard, wear-resistant material. If they are relatively small, such chips at the blade edge are responsible for defects sometimes referred to as lines or "tramlines". For larger chips, or for lower grammage of tissue, such chips may cause web breaks and holes in the tissue, with a considerable loss in productivity as the result.

In order to reduce such chipping at the blade edge, it has previously been proposed to provide the blade with a thermally sprayed top layer that forms a working edge, a sliding wear area and a web impact area, wherein the top layer comprises both chromia and titania (see WO2005/023533).

However, a more general solution to the above-referenced chipping issue is still sought. In particular, it would be highly advantageous if a solution to the chipping issue could be provided that is largely independent of particular material selections.

SUMMARY

The present invention is based upon an understanding of the underlying reasons for edge chipping in creping blades. A general idea behind the present invention is that if the edge of the creping blade, and more particularly the working apex thereof, is kept substantially free from crack defects or any kind of small defects that may initiate chipping, the blade tip will better resist stress, sliding wear and mechanical impact during creping.

The "working apex" of a creping blade is meant to denote the intersection or region formed between the sliding surface and the web impact surface of the blade.

The conventional design of a high performing creping blade is typically characterized by a prebevel at the blade tip of up to 10 degrees, and a wear-resistant material is applied to the prebeveled surface and/or the top surface (web impact area) of the blade. When the blade is loaded against the dryer, the blade will experience stress which in turn may cause micro-cracks or other crack defects in the wear-resistant blade covering. During creping, such cracks may lead to or promote chipping and the associated problems identified in the introduction above. Similar micro-cracks in the wear-resistant covering may also develop during manufacture, handling, packaging and distribution of the blades, where blade strips are often coiled for practical reasons.

Therefore, it is proposed according to the present invention to provide the creping blade with a sliding surface and a web impact surface designed such that the working apex of the blade is located at or close to the neutral fiber (or plane) of the blade.

As generally known to those of ordinary skill in the art, the "neutral fiber" of a beam-like structure (such as a blade) is the line or plane at which the structure is in an unstrained or unstressed state under a deflection load. For a deflected beam, material located on one side of the neutral fiber will experience a compressive stress, while material located on the other side of the neutral fiber will experience a tensile stress (see FIG. 5). Along the neutral fiber, however, the material will be considerably less stressed, and in the ideal case material along the neutral fiber will be stress-free. Thus, occurrence of cracks in the material along the neutral fiber, or close thereto, due to mechanical stress is considerably reduced.

It has been found that the advantageous effect of having the working apex of the blade located at or close to the neutral fiber is significant when the working apex is located no more than 30 percent of the total blade thickness away from the neutral fiber of the blade. Preferably, the working apex is located no more than 20 percent of the total blade thickness away from the neutral fiber, even more preferably no more than 10 percent of the total blade thickness away from the neutral fiber. In the optimal case, from a crack reduction point of view, the working apex of the blade is located substantially at the neutral fiber of the blade. In this context, it should be understood that the location of the working apex relative to the neutral fiber of the blade is determined as the shortest geometrical distance from the working apex to the geometrical plane of the neutral fiber, i.e. measured parallel to the blade thickness (see FIG. 4).

It will be understood that virtually any prebevel angle could be used for locating the working apex at or close to the neutral fiber of the blade. However, in order for the neutral fiber to be sufficiently well defined, and in order to facilitate deposition of the wear-resistant covering at the blade edge, it is preferred to have a prebevel angle larger than what is conventional, such that any deflection in the prebeveled part of the blade may be neglected. To this end, it is preferred to have a prebevel larger than about 25 degrees, or even larger than about 30 degrees, with respect to the face 110 of the blade substrate.

In embodiments of the present invention, it is also preferred to have a wear-resistant material provided at the blade tip, improving both the sliding wear-resistance against the dryer and the impact wear-resistant in the web impact area of the blade. The comparatively large prebevel mentioned above also facilitates the deposition of the wear-resistant material at the blade tip, as well as any post-grinding or similar of the wear-resistant material for forming the working apex at or close to the neutral fiber of the blade.

A creping blade according to the present invention has proven to possess very attractive properties with respect to wear-resistance, and particularly impact wear-resistance. Another benefit obtained by using the inventive creping blade is the excellent tissue quality consistency for the creped product. The closer the working apex is to the neutral fiber, the more pronounced is the improvement compared to conventional blades.

The inventive concept disclosed herein may be utilized for any type of blades, particularly high performance creping blades. High performance creping blades typically include a wear-resistant material at the blade tip applied by thermal spraying, such as APS plasma spraying or HVOF flame spraying, or by PVD (Physical Vapor Deposition) or CVD (Chemical Vapor Deposition). The wear-resistant material may include metal oxides, ceramic materials, silicates, carbides, borides, nitrides and mixtures thereof, for example alumina, chromia, zirconia, tungsten carbide, chromium carbide, zirconium carbide, tantalum carbide, titanium carbide and mixtures thereof. The wear-resistant material may alternatively be a cermet.

BRIEF DESCRIPTION OF THE DRAWINGS

In the following detailed description, reference is made to the accompanying drawings, on which.

DETAILED DESCRIPTION

Figure 1:
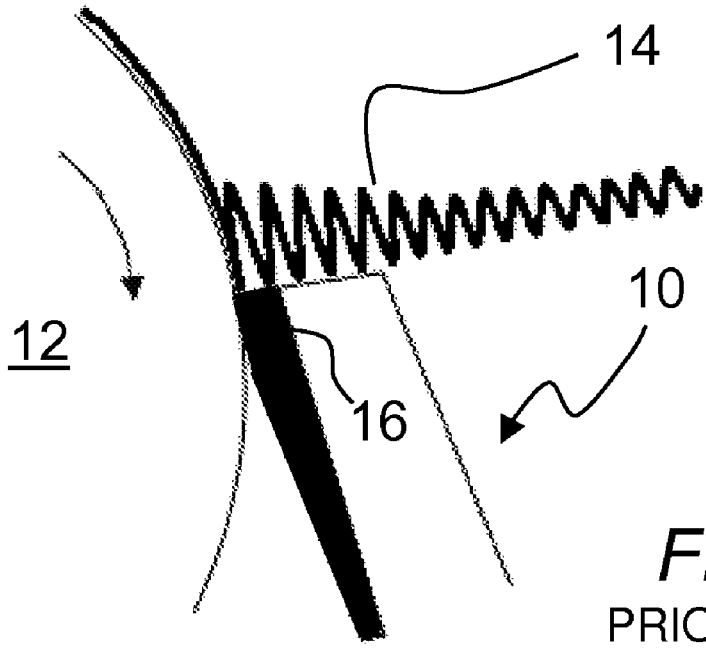
Fig. 1 PRIOR ART
FIG. 1 schematically shows a conventional creping blade in use for creping tissue from a Yankee dryer.

In FIG. 1, there is shown a conventional creping blade application, wherein a creping blade 10 is pressed against a Yankee dryer 12 in order to crepe a paper web 14 from the same in the production of tissue. As indicated in the figure, the blade may be provided with a wear-resistant material 16 at the blade tip. For the blade illustrated in FIG. 1, the wear-resistant material 16 forms both a sliding surface and a web impact surface of the blade 10. It is evident from the figure that the working apex (i.e. the region or edge formed between the sliding surface and the web impact surface) of the blade 10 is located far away from the neutral fiber of the blade. Therefore, this working apex may have experienced stress during manufacture, handling, packaging and transport before the blade was loaded against the dryer, leading to crack defects in the wear-resistant covering 16. Any initial defects present at the blade tip already when it was loaded against the dryer 12—such as cracks and micro-chips, even very small such cracks or chips—will constitute weakened points at which wear and/or defect propagation may easily nucleate or initiate during creping. Such occurrences lead to a situation where the integrity of the blade tip (sliding surface, web impact surface and working apex) cannot be preserved for a prolonged period of time, leading to the need for premature blade changes.

Figure 2:
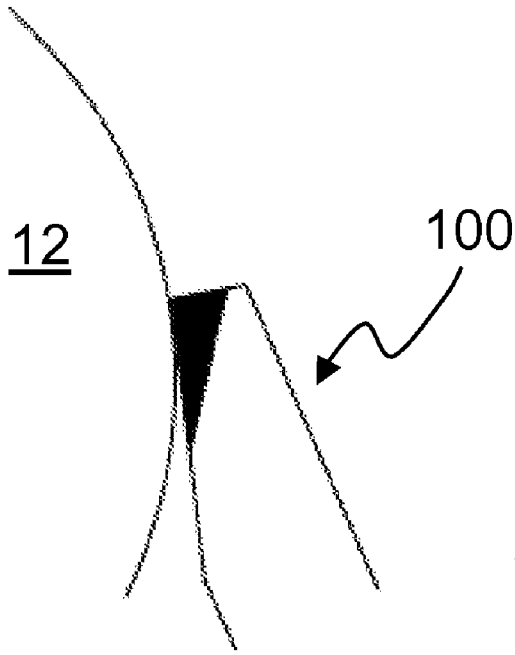
FIG. 2 schematically shows how the inventive creping blade is loaded against a Yankee dryer.
Figure 3:
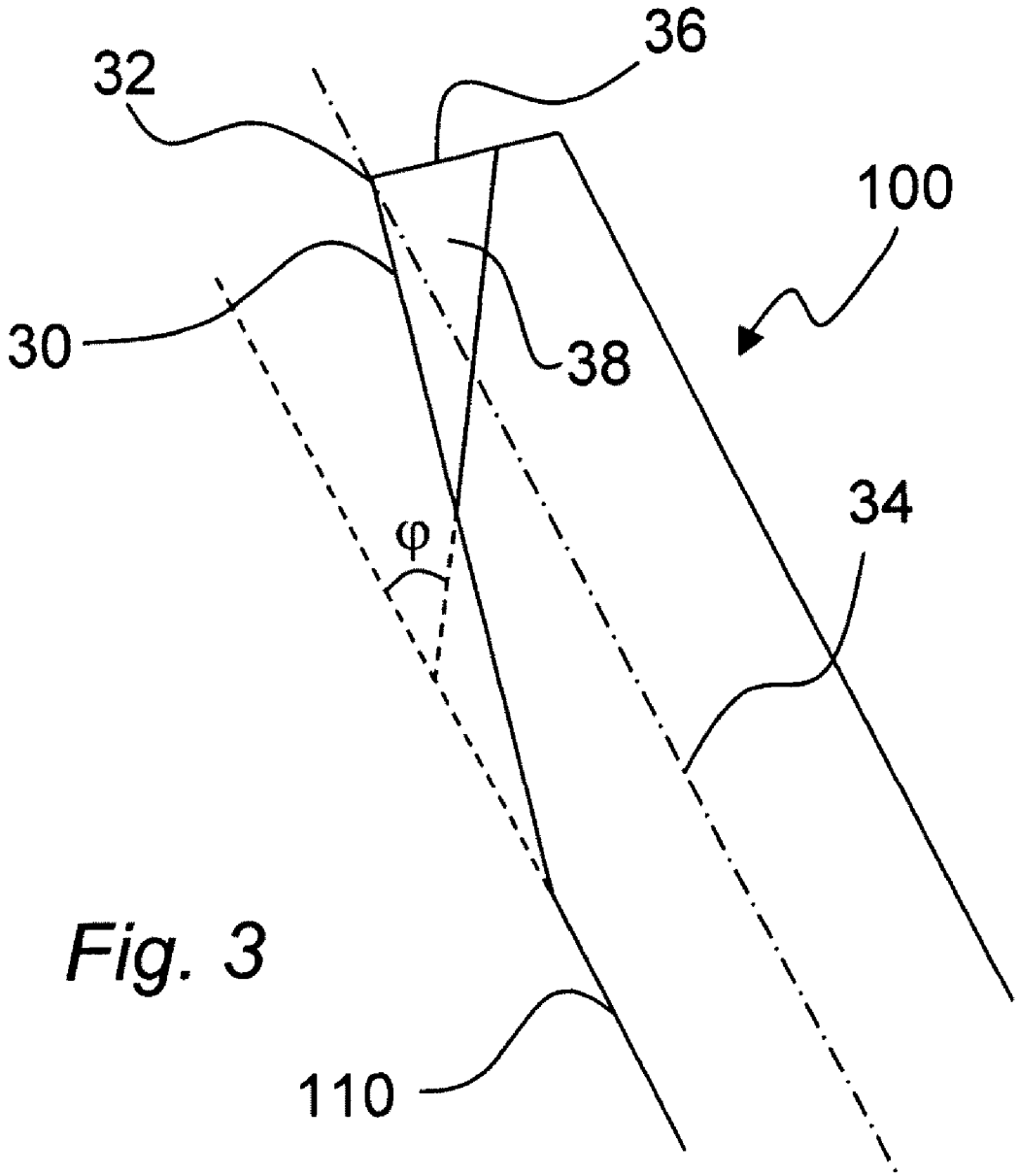
FIG. 3 schematically shows the tip and the working apex of a creping blade according to the present invention.

FIG. 2 schematically shows a situation similar to that of FIG. 1, but for a creping blade 100 according to the present invention. The inventive blade is shown in more detail in FIG. 3. The creping blade is provided with a sliding surface 30 which faces the dryer 12 during creping, a working apex 32 and a web impact surface 36. Also indicated in FIG. 3 is the neutral fiber 34 of the blade. As explained above, the neutral fiber is the line or plane at which the material of the blade is substantially stress-free under a deflection load.

Contrary to conventional creping blades, the inventive blade 100 preferably has a prebeveled angle (indicated at $\phi$) which is about 25-30 degrees or larger with respect to the blade face 110. On the prebeveled surface of the blade, there is provided a wear-resistant material 38, designed such that the working apex 32 of the blade is located at or close to the neutral fiber 34. As also indicated in FIG. 3, the wear-resistant material 38 may form both the sliding surface 30 and the web impact surface 36 of the blade 100.

Figure 4:
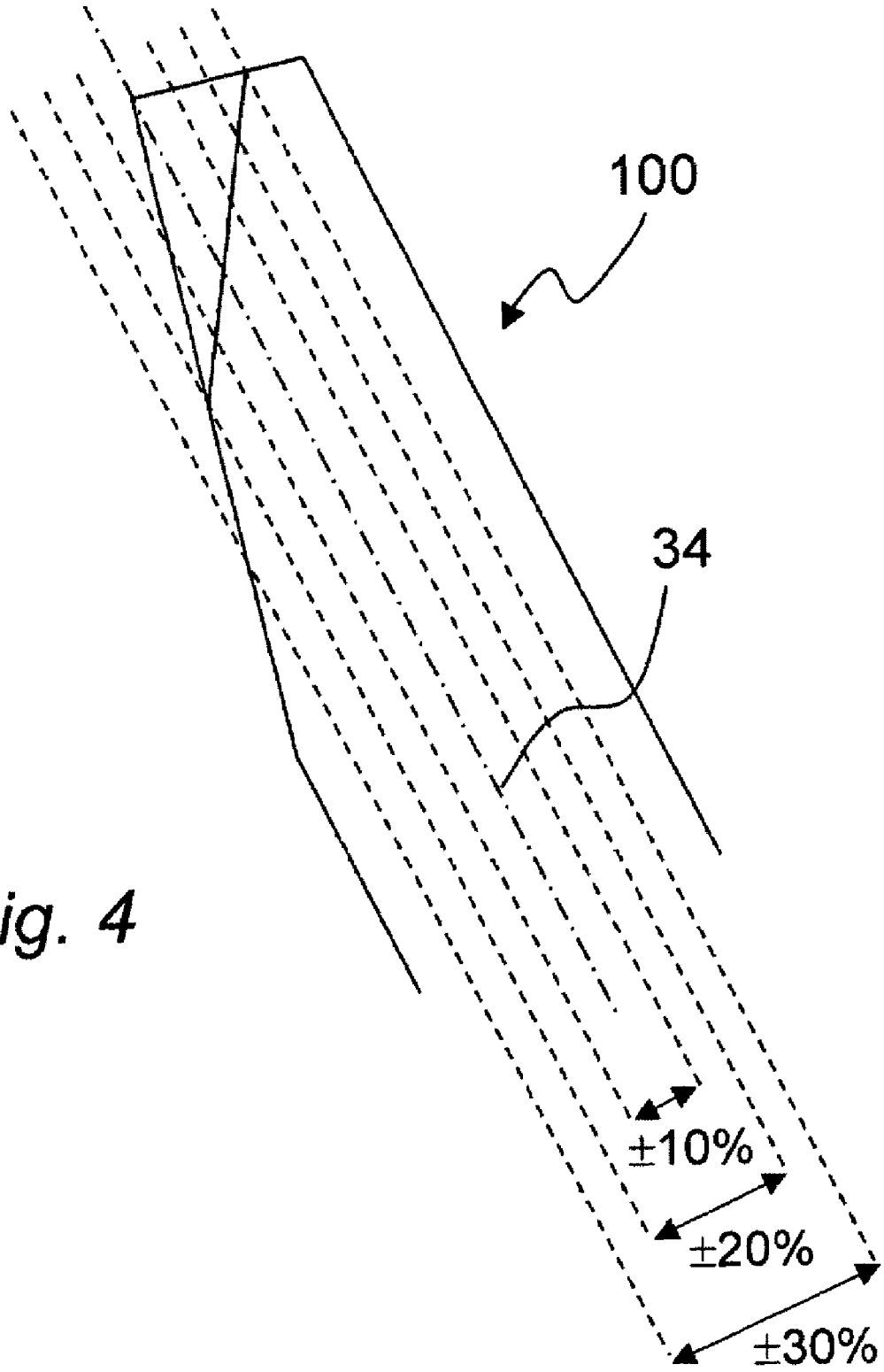
FIG. 4 illustrates the location of the working apex with respect to the neutral fiber of the blade.

In general, and as indicated in FIG. 4, the working apex of the blade may be located up to 30 percent of the total blade thickness away from the neutral fiber. In FIG. 4, the dash-dotted line indicates the neutral fiber 34 of the blade, while the dashed lines indicate distances from the neutral fiber of ±10%, ±20% and ±30% of the total blade thickness. As explained above, the working apex 32 of the inventive blade may be located up to 30% of the total blade thickness away from the neutral fiber 34, but is most preferably located as close as possible to the neutral fiber.

Figure 5:
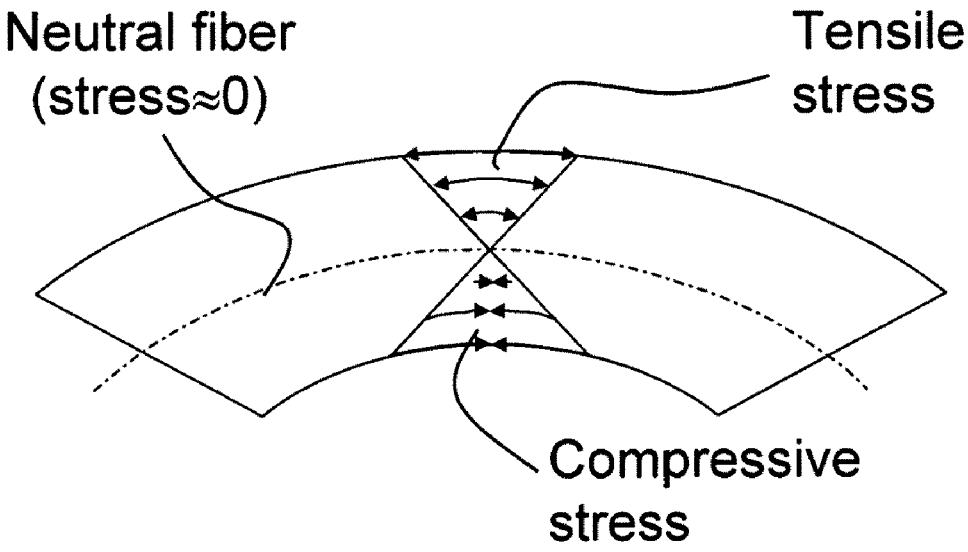
FIG. 5 is a schematic drawing explaining how a neutral fiber of the blade is formed during bending.

FIG. 5 schematically shows how tensile and compressive stress is induced in a blade under a bending load. The blade is illustrated under a typical bending load that occur when blades are coiled during manufacturing, handling, packaging and distribution. The view of FIG. 5 is taken along the length of the blade, seen from the blade tip. As indicated, one side of the blade will experience a tensile stress when bent, while the opposite side of the blade will experience a compressive stress. It is under such tensile and/or compressive stress that micro-cracks in the wear-resistant deposit at the blade tip may occur, later leading to premature failure of the blade during creping.

In a method for manufacturing the inventive creping blade, a prebevel is first provided on a longitudinal edge of a base substrate. A wear-resistant material is then applied on said prebevel. The wear-resistant material applied on the prebevel is then shaped such that it forms a sliding surface for contact with a dryer surface and a web-impact surface upon which a paper web impacts during creping, a working apex being formed between the sliding surface and the web impact surface. The shaping of the wear-resistant material is shaped such that the working apex is located no more than 30 percent of the total blade thickness away from a neutral fiber of the blade. Preferably, the working apex is located no more than 20 percent, more preferably no more than 10 percent, of the total blade thickness away from the neutral fiber of the blade.

Preferably, the prebevel is formed to have an angle of at least 25 degrees with respect to the blade surface.

The wear-resistant material is suitably a ceramic material, a cermet material or a carbide material. For example, the wear-resistant material may be selected from metal oxides, ceramic materials, silicates, carbides, borides, nitrides and mixtures thereof. Particular examples of suitable wear-resistant materials are alumina, chromia, zirconia, tungsten carbide, chromium carbide, zirconium carbide, tantalum carbide, titanium carbide and mixtures thereof.

Preferably, the wear-resistant material is applied by thermal spraying, physical vapor deposition or chemical vapor deposition.

Example 1

In a tissue mill, trials were performed using three different types of blades. The first type, called Type A, was a standard steel blade used as a reference. The second type, called Type B, was applicant's own prior art blade (test blade designated "Proto-173"), having a thermally sprayed, wear-resistant material applied at the working tip of the blade for protection. The third type, called Type C, was an improved coating blade according to the present invention, using a similar wear-resistant material as for the Type B blade.

The following operating conditions were used in this trial:

Paper web made from 100% recycled fiber
Final product was industrial towel type tissue (toilet paper)
Grammage: 27.5 g/m$^2$ (no wet strength agent)
Yankee speed: 750-850 m/min
Reel speed: 655-684 m/min (i.e. crepe ratio of 15-19.5%)
Yankee surface: Cast iron
Web moisture: 7.0-6.7%
Creping blade dimensions: 1.2×110×3440 mm (thickness×width×length)
Blade bevel: 80 degrees (−10 degrees from square)
Blade load: 3.5-5.0 kN/m
Stick-out: 14 mm
Base adhesive: Rezosol 8289 @ 1.4-1.8 mg/m$^2$
Release composition: Rezosol 3119 @ 16-25 ml/min
No modifier A blade of Type A is typically used in current creping facilities, since high performance blades have heretofore often been associated with chipping problems. The working life-time for such blade is on the average about 2-3 hours.

Figure 6:
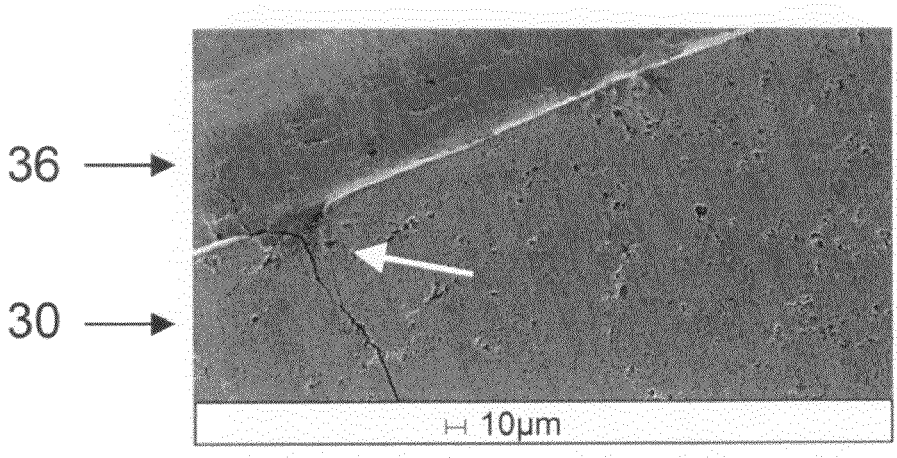
FIGS. 6-9 are SEM images showing comparative studies for the inventive blade.

In comparison, a blade of Type B tested on the same machine, normally used with the Type A blades, lasted less than 1 hour before a blade change was required due to line defects appearing on the creped tissue. Over time, there was a tendency for such line defects to increase in number and intensity. FIG. 6 shows an image of typical chipping at the blade tip creating said line defects. The arrow in the figure indicates a micro-crack at the blade tip and the associated chipping that occurred during the creping process for this blade. The cause of the chipping was the high stress applied to the wear-resistant material of the Type B blades during creping. The sliding surface 30 against the dryer and the web impact area 36 of the blade are also indicated in the figure.

Particularly, it should be noted that damage to the blade tip may occur at comparatively low stress, due to the presence of initial defects, as shown in FIG. 6, that may constitute weak points at which cracking or chipping is initiated.

For highly wear-resistant materials, chipping is a particular drawback, since highly wear-resistant materials are typically also brittle. Once chipping has occurred at the tip of the blade, the chips defect will remain because there is substantially no sliding wear that could "polish off" or "grind down" those chips defects. On the contrary, an ordinary steel blade (Type A) is considerably less wear-resistant than the high performance blades, but the general high toughness of steel blades leads to less problems related to chipping at the blade tip. Moreover, in case any chipping should occur in a steel blade, the wear of the blade will automatically remove such defects over time.

Figure 7:
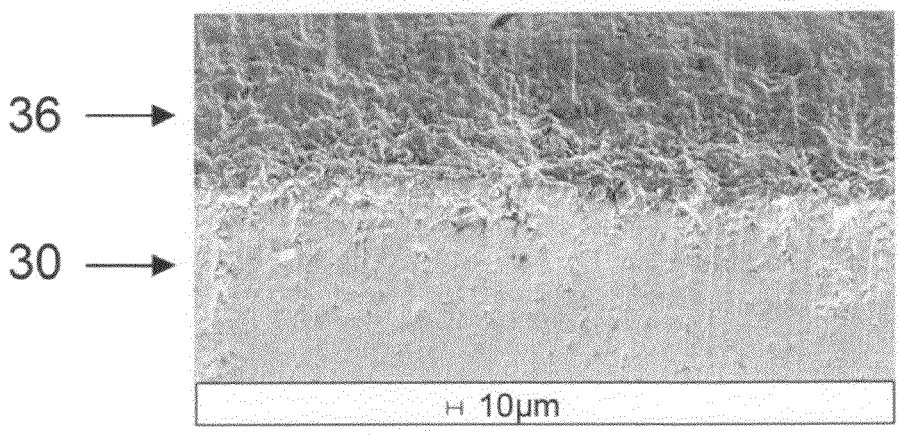

An inventive blade (Type C) was tested in the same environment as the blades of Types A and B. The inventive blade was run for 25 hours and was thereafter removed from the paper making machine for inspection. When the inventive blade was removed after 25 hours, it still provided a satisfactory creping result. FIG. 7 shows an image of the blade edge after 25 hours of usage. Although the blade is worn due to abrasive and erosive wear, the integrity of the blade tip is maintained and no chipping could be identified. It could be concluded that the blade tip for the inventive blade was in a considerably better condition compared to any other kind of worn blades. Also in FIG. 7, the sliding surface 30 and the web impact surface 36 are indicated.

Figure 10:
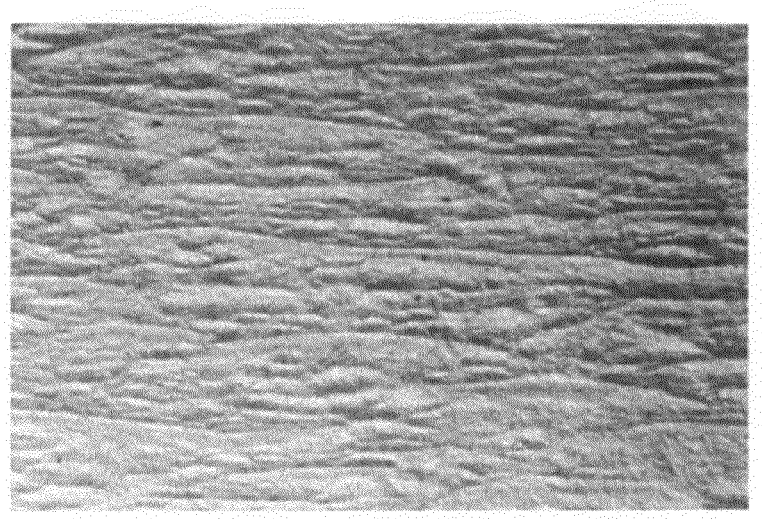
FIGS. 10 and 11 are images showing tissue creped using a prior art blade and the inventive blade, respectively.
Figure 11:
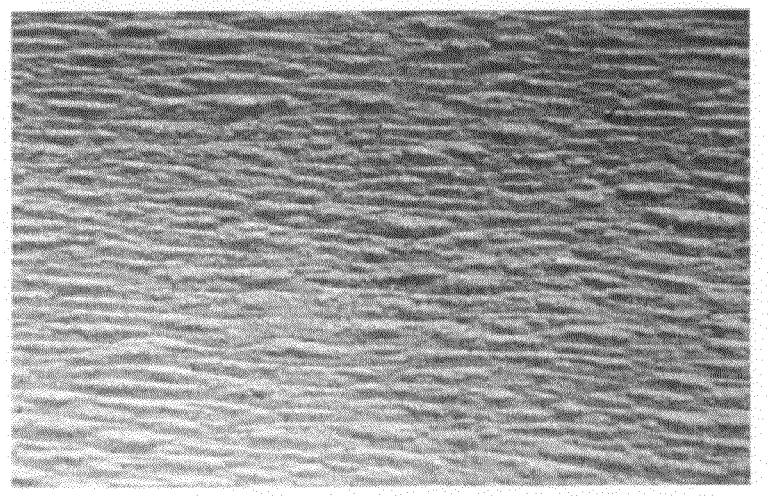

As a consequence of the predictable wear for the inventive blade, tissue can be manufactured with high quality over a drastically longer time compared to prior art blades. FIGS. 10 and 11 show the difference in surface texture for tissue creped by a conventional Type A blade (FIG. 10) and a Type C blade according to the invention (FIG. 11).

Example 2

On another tissue machine, comparative trials were performed using two different types of blades. The first type, called Type D (test blade designated "Proto-C2PGA"), was a prior art ceramic blade based on standard geometry. The second blade, called Type E, was a ceramic blade according to the present invention. Basically, the blade tip geometries differ between the two tested blades, but the protective material (i.e. the wear-resistant material at the tip of the blades) is the same for both blades and applied under the same conditions.

Figure 8:
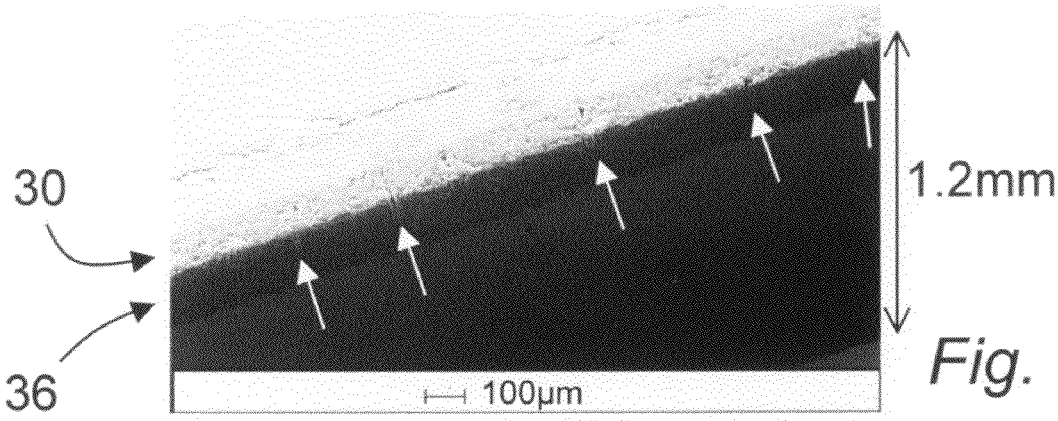

The following operating conditions were used in this trial:

Paper web made from 100% recycled fiber
Final product was industrial towel type tissue (toilet paper)
Grammage: 17.2 g/m$^2$ (no wet strength agent)
Yankee speed: 1470 m/min
Yankee surface: Voith Endura
Web moisture: 4.0%
Creping blade dimensions: 1.2×100×2980 mm (thickness×width×length)
Blade bevel: 80 degrees (−10 degrees from square)
Stick-out: 35 mm
Base adhesive: Cotac 3149H @ 3.2-4.1 mg/m$^2$
Release composition: Agent 42 @ 3.2-3.6 l/h
No modifier In these trials, the blade of Type D was applicant's prior art, high performance blade. These blades are performing reasonably well, producing the required tissue quality for a sufficient period of time. Nevertheless, the tissue quality does decrease over time, with apparition of lines that eventually become unacceptable. FIG. 8 shows the blade of Type D after a typical working time. A number of cracks are visible located at the tip of the blade on the impact and sliding surface (indicated by arrows in the figure). Some chipping may also be identified in connection with these cracks.

It has been identified that even very fine cracks in the hard and brittle wear-resistant material at the blade tip may lead to larger cracks and chipping during the service life of the blade. Therefore, avoiding such micro cracks at the blade tip may lead to drastically longer service life for the inventive blades. The blade of Type D according to this example has a conventional design, wherein the blade thickness at the working tip is approximately the same as the overall blade thickness (tip thickness and overall blade thickness approximately 1.2 mm). Consequently, the working apex (i.e. the edge or region formed between the sliding surface and the web impact surface) of the Type D blade is located far away from the neutral fiber of the blade, namely very close to one side of the blade. During manufacturing, handling and packaging, the ceramic edge deposit will thus encounter various kinds of tensile stress, thereby promoting micro cracks at the tip of the blade already before it has been mounted in the paper making machine.

Figure 9:
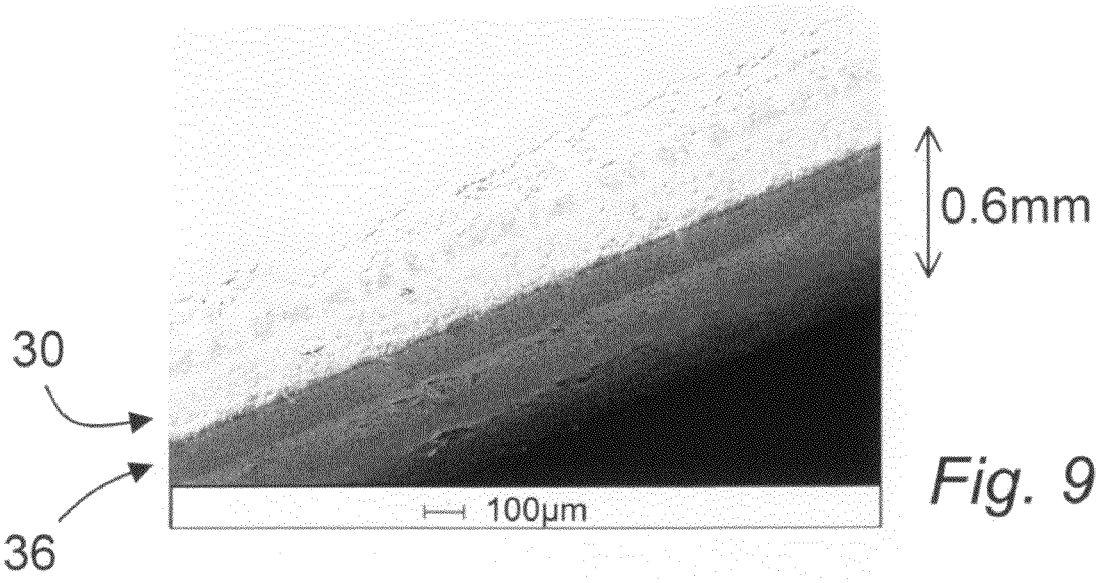

The blade of Type E (according to the present invention) was manufactured in order to position the working apex at close as possible to the neutral fiber of the blade (i.e. typically at the center of the blade thickness). In FIG. 9, the blade of Type E is shown, and the width at the blade tip of about 0.6 mm, equal to half the overall blade thickness, is indicated. This blade of Type E ran for 6 hours without any quality problems for the creped product occurring. FIG. 9 shows the blade tip after the 6 hours trial run, and no cracking or chipping occurrences may be seen.

Both the sliding surface 30 and the web impact surface 36 are indicated in FIGS. 8 and 9.

Referring back to FIG. 3, the prebevel that is provided on the blade substrate before any wear-resistant material is deposited at the blade tip is indicated by $\phi$. It is preferred, according to the present invention, to have this prebevel considerably larger than what is normal for prior art creping blades. According to the present invention, it is preferred to have a prebevel of about 25-30 degrees or more, while for prior art blades, the prebevel is typically below 10 degrees. One main reason for having such large prebevel is that it makes it easier during manufacturing to position the working apex of the blade tip close to the neutral fiber. For smaller prebevels, it becomes increasingly difficult to design the wear-resistant material such that the working apex is located at or close to the neutral fiber of the blade.

The invention claimed is:

1. A blade for creping a paper web from a dryer surface, comprising:

a sliding surface facing the dryer surface during use of the blade, a web impact surface upon which the paper web impacts during creping, and a working apex formed between the sliding surface and the web impact surface, wherein the working apex and at least some portion of the sliding surface and the web impact surface comprise a wear-resistant material applied onto a base substrate, and wherein the working apex of the blade as manufactured is located no more than 30 percent of the total blade thickness away from a neutral fiber of the blade.

2. The blade according to claim 1, wherein the working apex is located no more than 20 percent of the total blade thickness away from the neutral fiber of the blade.

3. The blade according to claim 1, wherein the working apex is located no more than 10 percent of the total blade thickness away from the neutral fiber of the blade.

4. The blade according to claim 1, wherein the working apex is located substantially at the neutral fiber of the blade.

5. The blade according to claim 1, wherein the wear-resistant material is applied upon a prebeveled surface formed on the base substrate, and wherein the prebeveled surface has an angle ($\phi$) with respect to a blade face of at least 25 degrees.

6. The blade according to claim 1, wherein the wear-resistant material is selected from a ceramic material, a cermet material, and a carbide material.

7. The blade according to claim 1, wherein the wear-resistant material is a material applied to the base substrate by thermal spraying, physical vapor deposition, or chemical vapor deposition.

8. The blade according to claim 1, wherein the wear-resistant material is selected from metal oxides, ceramic materials, silicates, carbides, borides, nitrides, and mixtures thereof.

9. The blade according claim 8, wherein the wear-resistant material is selected from alumina, chromia, zirconia, tungsten carbide, chromium carbide, zirconium carbide, tantalum carbide, titanium carbide, and mixtures thereof.

* * * * *